US007497160B2

(12) United States Patent
Kumagai

(10) Patent No.: US 7,497,160 B2
(45) Date of Patent: Mar. 3, 2009

(54) INTAGLIO PRINTING PRESS

(75) Inventor: Norihiro Kumagai, Noda (JP)

(73) Assignee: Komori Corporation, Tokyo (JP)

( * ) Notice: Subject to any disclaimer, the term of this patent is extended or adjusted under 35 U.S.C. 154(b) by 326 days.

(21) Appl. No.: 11/088,781

(22) Filed: Mar. 25, 2005

(65) Prior Publication Data

US 2005/0211116 A1 Sep. 29, 2005

(30) Foreign Application Priority Data

Mar. 25, 2004 (JP) ..... 2004-088643

(51) Int. Cl.
*B41F 9/00* (2006.01)

(52) U.S. Cl. ..... 101/153; 101/155

(58) Field of Classification Search ..... 101/153–155, 101/157, 167, 169, 161, 350.5, 350.6, 423, 101/425
See application file for complete search history.

(56) References Cited

U.S. PATENT DOCUMENTS 3,972,667 A * 8/1976 Hanusa ..... 425/224
4,516,496 A 5/1985 Giori
2004/0159249 A1* 8/2004 Endo ..... 101/152

FOREIGN PATENT DOCUMENTS

| | | | |
|---|---|---|---|
| CA | 430151 | | 9/1945 |
| GB | 335026 | A | 9/1930 |
| GB | 803546 | A | 10/1958 |
| JP | 2-42070 | B2 | 9/1990 |
| JP | 08292195 | A * | 11/1996 |
| WO | WO-2007/113640 | | 10/2007 |

* cited by examiner

*Primary Examiner*—Ren Yan
(74) *Attorney, Agent, or Firm*—Birch, Stewart, Kolasch & Birch, LLP

(57) ABSTRACT

An intaglio printing press includes an intaglio cylinder supported rotatably, an inking device for supplying ink to the intaglio cylinder, a wiping device for removing a surplus ink of the ink supplied to the intaglio cylinder, and a prewiping device, provided upstream of the wiping device and downstream of the inking device in the direction of rotation of the intaglio cylinder, for removing the ink before being removed by the wiping device. The prewiping device has a belt conveyor device for discharging the removed ink to the outside of the printing press.

7 Claims, 10 Drawing Sheets

INTAGLIO PRINTING PRESS

CROSS REFERENCE TO RELATED APPLICATION

The entire disclosure of Japanese Patent Application No. 2004-088643 filed on Mar. 25, 2004, including specification, claims, drawings and summary, is incorporated herein by reference in its entirety.

BACKGROUND OF THE INVENTION

1. Field of the Invention

This invention relates to an intaglio printing press having an ink recovery function.

2. Description of the Related Art

Intaglio printing is a printing method which uses a plate having image areas formed to be concave relative to non-image areas (i.e., intaglio plate). In this type of printing, ink is filled throughout the plate, then ink in the non-image areas is wiped off to leave ink only in the image areas, and then paper is strongly pressed against the plate to transfer ink remaining in the image areas to the paper.

An example of an intaglio printing press used in the intaglio printing is shown in FIG. 10. In the drawing, arrows show the direction of rotation of a cylinder or roller.

Reference numeral 101 denotes an intaglio cylinder, which is in contact with an impression cylinder 102. An intaglio plate, which is formed from a flat smooth surface as non-image areas and depressions as image areas, is mounted around the intaglio cylinder 101. A plurality of inking devices 103 are provided on one side of the intaglio cylinder 101. Pattern rollers 104, which are ink form rollers of the inking devices 103, are in contact with the intaglio cylinder 101. Ink fountain rollers 106 of ink fountains 105, where inks of different colors are stored, are in contact with the pattern rollers 104. The pattern roller 104 has a convex pattern portion formed on the surface so that ink supplied to the pattern roller 104 is supplied only to those parts of the intaglio plate which are to be supplied with ink of the relevant color. That is, the ink fountain roller 106 transfers ink only to the convex pattern portion of the pattern roller 104, and the ink is transferred from this pattern portion to predetermined locations (image areas and non-image areas) of the intaglio plate.

A wiping device 107, as an ink removing device, is provided ahead of the site of contact between the intaglio cylinder 101 and the impression cylinder 102, and laterally of the intaglio cylinder 101. A wiping roller 108 of the wiping device 107 is in contact with the intaglio cylinder 101. The wiping roller 108 wipes off a surplus ink from the intaglio plate. That is, ink remains only in the image areas of the intaglio plate. The wiping roller 108 is soaked in a cleaning solution 110 within a cleaning tank 109.

(Alternatively, the surface of the wiping roller 108 is sprayed with the cleaning solution by a spray.) The ink wiped off is cleaned off by a cleaning unit (not shown) in contact with the wiping roller 108 within the cleaning solution 110.

A sheet 111 is supplied between the intaglio cylinder 101 and the impression cylinder 102. The sheet 111 is strongly pressed against the intaglio plate of the intaglio cylinder 101 by the impression cylinder 102, whereby ink in the image areas of the intaglio plate is transferred to the sheet 111. A so-called intaglio-printed sheet is transported to a delivery unit, not shown, by a delivery device (delivery chain) 112.

As stated earlier, the surplus ink of the ink supplied to the intaglio plate is wiped off by the wiping roller 108. However, the surplus ink is not sufficiently wiped off by the wiping roller 108 alone. Thus, as disclosed in Japanese Patent Publication No. 1990-42070 (column 6, drawing), a prewiping roller constituting a prewiping device as an ink removing device may be provided ahead (upstream) of the wiping roller 108 to wipe off the surplus ink before it is wiped off by the wiping roller 108.

The amount of ink wiped off by the wiping roller 108 is considerable, and thus its recovery has been desired. Particularly, recovery of ink of a color used in a large amount, and recovery of expensive ink have been desired.

However, if ink is removed by soaking of the wiping roller 108 in the cleaning solution, the ink mixes with the cleaning solution, and is no longer separable for recovery, and has thus been discarded. Even in Japanese Patent Publication No. 1990-42070, only prewiping is performed, and a prewiped ink is considered to have been discarded.

Thus, it is attempted to recover ink before being wiped off by the wiping roller 108. Currently, recovery of ink is performed by an operator, who uses a spatula or the like to scrape off the ink transferred from the surface of the intaglio plate to the surface of a roller or the like, and returns the ink to the ink fountain 105.

However, this ink recovery operation requires the operator to use a spatula inside a narrow printing press to scrape off the ink. Thus, this operation is complicated, and imposes a heavy burden on the operator, thereby presenting problems of taking a make-ready time and decreasing productivity. Even with a structure in which the recovered ink is stored in a catch pan within the printing press, this catch pan has to be mounted inside and detached from the printing press, thereby imposing a heavy load on the operator.

SUMMARY OF THE INVENTION

The present invention allows an operation to perform ink recovery, without bothering him/her, and increases productivity, by facilitating recovery of ink on a rotator.

A first aspect of the present invention provides an intaglio printing press, comprising: an intaglio cylinder supported rotatably; and an ink removing device for removing a surplus ink from an ink supplied to the intaglio cylinder, and wherein the ink removing device has a belt conveyor device for discharging the removed surplus ink to an outside of the printing press.

A second aspect of the present invention, according to the first aspect, wherein the ink removing device has a belt conveyor blade for scraping off the ink on the belt conveyor device.

A third aspect of the present invention, according to the first aspect, wherein an hourglass-shaped roller having a narrowed middle is used as a roller of the belt conveyor device to render a middle of a belt of the belt conveyor device concave along the narrowed middle of the roller.

A fourth aspect of the present invention, according to the first aspect, wherein on a belt of the belt conveyor device, a wall portion, which comprises a plurality of small walls arranged side by side in a longitudinal direction of the belt, is provided along each of side edge portions of the belt.

A fifth aspect of the present invention, according to the first aspect, further including, an inking device for supplying ink to the intaglio cylinder, and wherein the ink removing device is a prewiping device provided upstream, with respect to a direction of rotation of the intaglio cylinder, of a wiping device for removing the surplus ink from ink supplied to the intaglio cylinder, and which is provided downstream of the inking device in the direction of rotation of the intaglio cylinder for removing the ink before being removed by the wiping device.

A sixth aspect of the present invention, according to the fifth aspect, wherein the prewiping device further includes an ink transfer roller supported rotatably, and a blade for scraping off ink on the ink transfer roller, and the belt conveyor device discharges the ink scraped off by the blade to the outside of the printing press.

A seventh aspect of the present invention, according to the sixth aspect, wherein the prewiping device has a prewiping roller in contact with the intaglio cylinder, and the ink transfer roller is in contact with the prewiping roller.

An eighth aspect of the present invention, according to the seventh aspect, wherein the prewiping roller has a convex pattern region corresponding to locations, where a desired ink is applied, in order to transfer the desired ink on the intaglio cylinder to the prewiping roller.

A ninth aspect of the present invention, according to the fifth aspect, further including, a container for accommodating the ink transported outside by the belt convey or device, and an ink returning device for supplying the ink within the container to the inking device.

A tenth aspect of the present invention, according to the ninth aspect, wherein the ink returning device including, piping for communication between the container and the inking device, pressure imparting means for exerting pressure on an interior of the container, and a pump for pumping out ink, which has been pushed out to the piping by the pressure imparting means, to the inking device.

An eleventh aspect of the present invention, according to the tenth aspect, wherein the pressure imparting means comprises a piston portion movable up and down within the container in a liquid-tight manner.

A twelfth aspect of the present invention, according to the eleventh aspect, further including a pump comprising a spiral shaft, and a drive motor for rotationally driving the pump.

According to the first aspect of the present invention, ink removed from the intaglio cylinder can be transported to the outside of the printing press by the belt conveyor device. Thus, ink can be easily recovered, the burden on the operator can be decreased markedly, and productivity can be increased remarkably. Moreover, ink with high viscosity can be easily discharged to the outside of the printing press by the belt conveyor device.

According to the second aspect of the present invention, ink transported to the outside of the printing press by the belt conveyor device is reliably scraped off by the belt conveyor blade, and is stored into the container installed outside the printing press.

According to the third aspect of the present invention, ink with relatively low viscosity can be reliably held on the belt, and smoothly transported.

According to the fourth aspect of the present invention, ink with relatively low viscosity can be reliably held on the belt, and smoothly transported.

According to the fifth aspect of the present invention, ink, which has been removed by the prewiping device provided ahead of the wiping device for removing surplus ink, can be transported to the outside of the printing press by the belt conveyor device. Thus, ink can be easily recovered, the burden on the operator can be decreased markedly, and productivity can be increased remarkably. Moreover, ink with high viscosity can be easily discharged to the outside of the printing press by the belt conveyor device.

According to the sixth aspect of the present invention, ink transferred onto the ink transfer roller is reliably scraped off by the blade, and discharged to the belt conveyor device.

According to the seventh aspect of the present invention, surplus ink on the intaglio cylinder is transferred onto the ink transfer roller via the prewiping roller, and is then reliably scraped off by the blade, and discharged to the belt conveyor device.

According to the eighth aspect of the present invention, desired ink on the intaglio cylinder can be recovered, and the recovered ink can be returned to the inking device for recycling.

According to the ninth aspect of the present invention, ink in the container is returned to the inking device by the ink returning device for the purpose of recycling. A combination of the belt conveyor device and the ink returning device can construct an ink recycling system, which eliminates a waste of ink recovered from the intaglio cylinder.

According to the tenth aspect of the present invention, ink is pushed out to the piping by the pressure imparting means, and the pushed-out ink is sent out by the pump. Thus, ink with high viscosity can be reliably pushed to the pump, thus making possible the recycling of highly viscous ink.

According to the eleventh aspect of the present invention, ink with high viscosity can be reliably pushed to the pump, thus making possible the recycling of highly viscous ink.

According to the twelfth aspect, ink with high viscosity can be reliably pressure-fed, thus making possible the recycling of highly viscous ink.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

An intaglio printing press according to the present invention will now be described in detail by embodiments with reference to the accompanying drawings, which in no way limit the invention.

Embodiment 1

Figure 1:
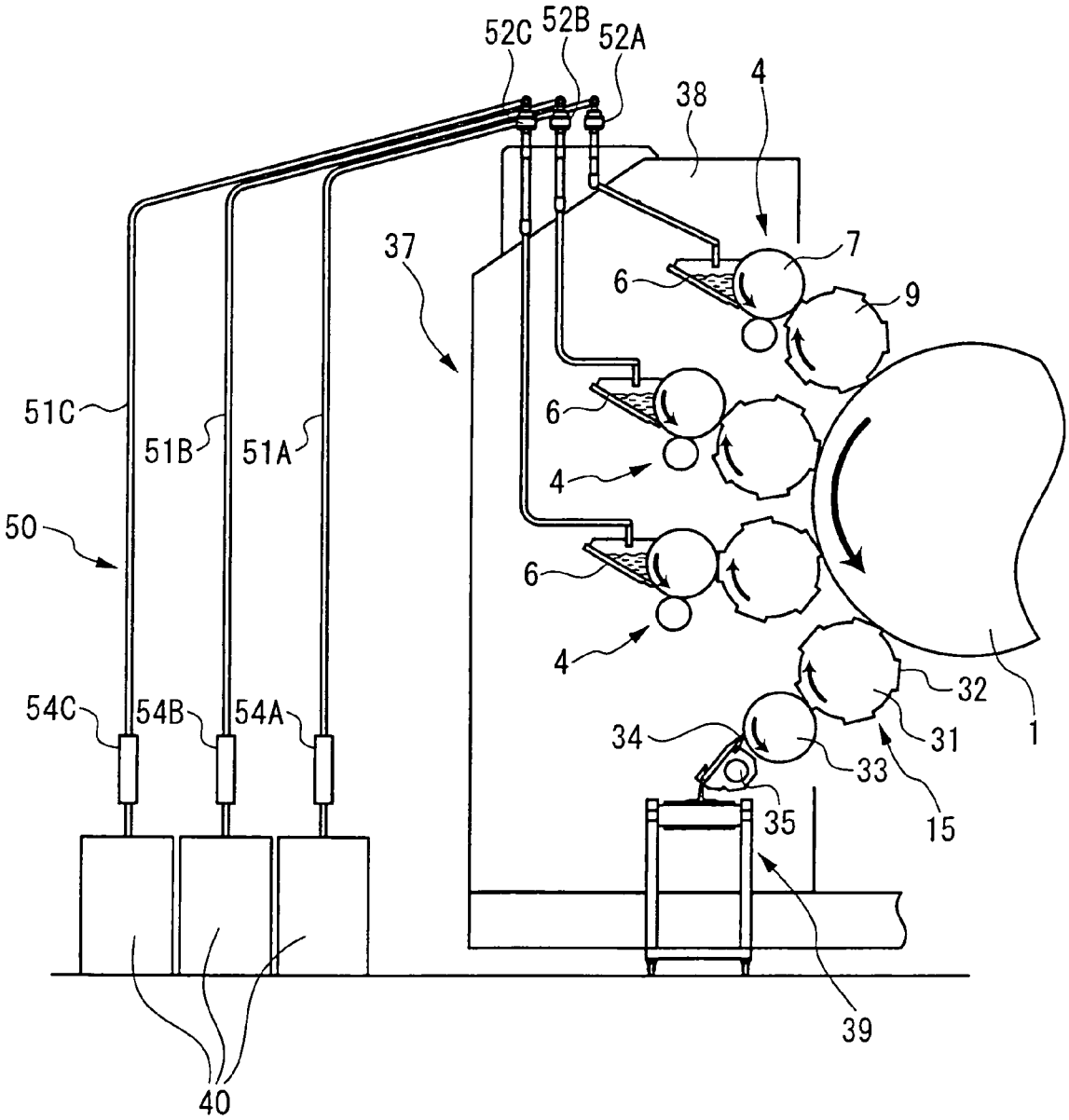
FIG. 1 is a schematic side view of an ink removing device portion and an ink returning device portion of an intaglio printing press showing Embodiment 1 of the present invention.
Figure 2:
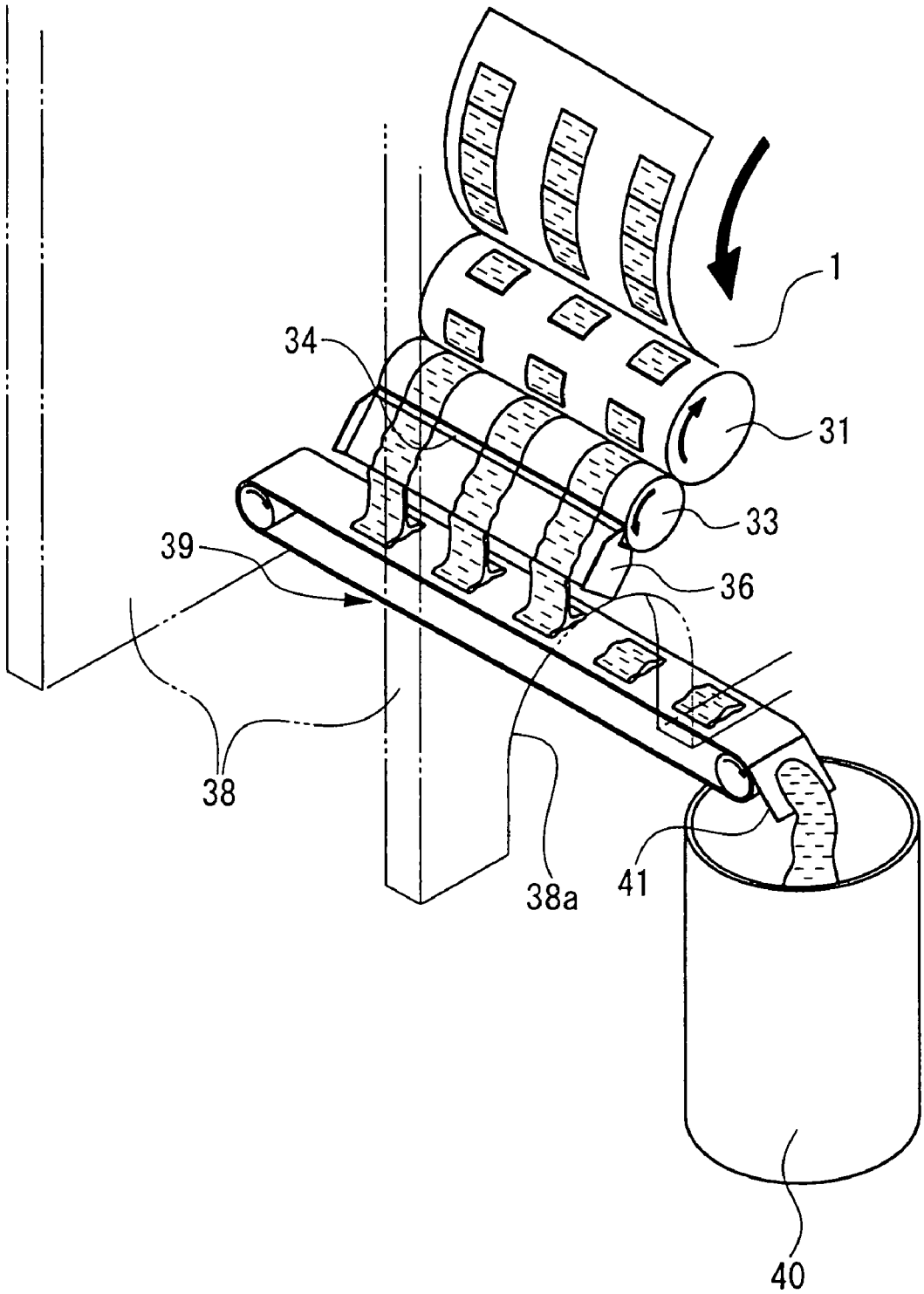
FIG. 2 is a schematic perspective view of the ink removing device portion.
Figure 3:
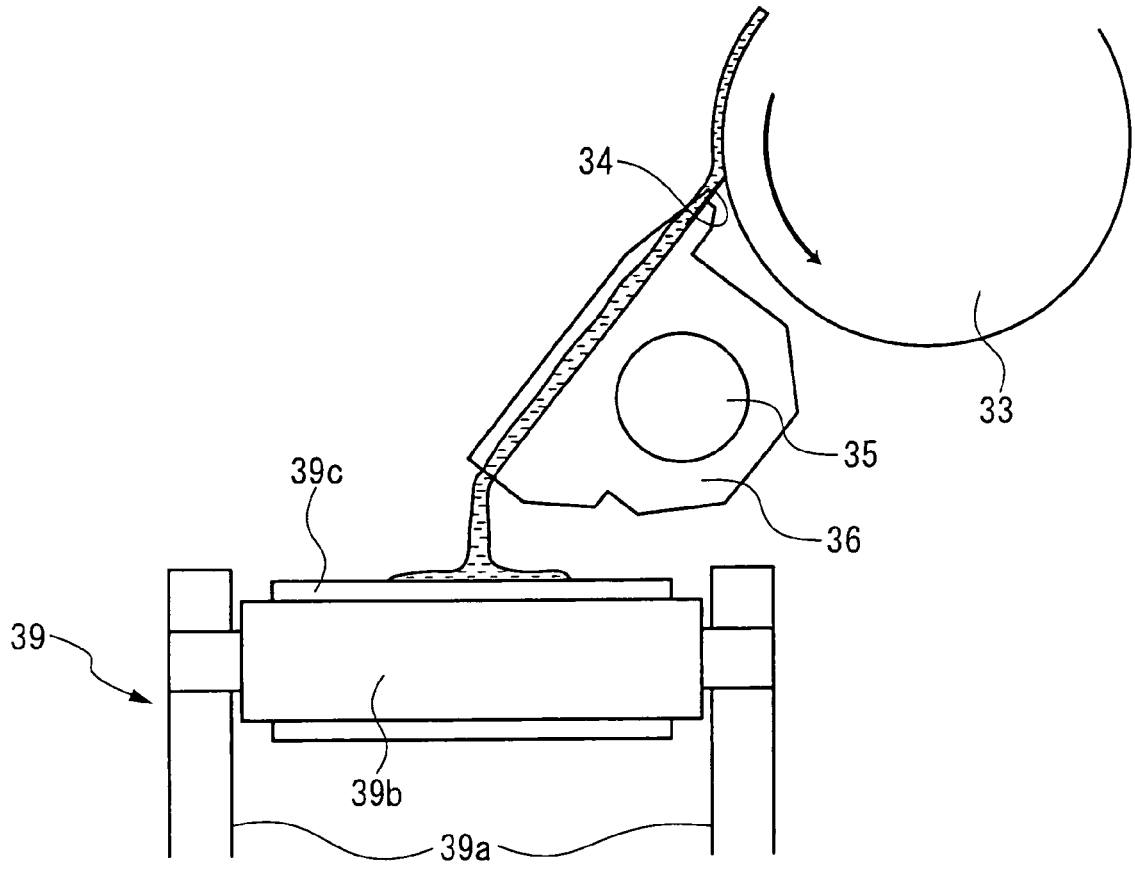
FIG. 3 is an enlarged view of essential parts of the ink removing device portion.
Figure 4:
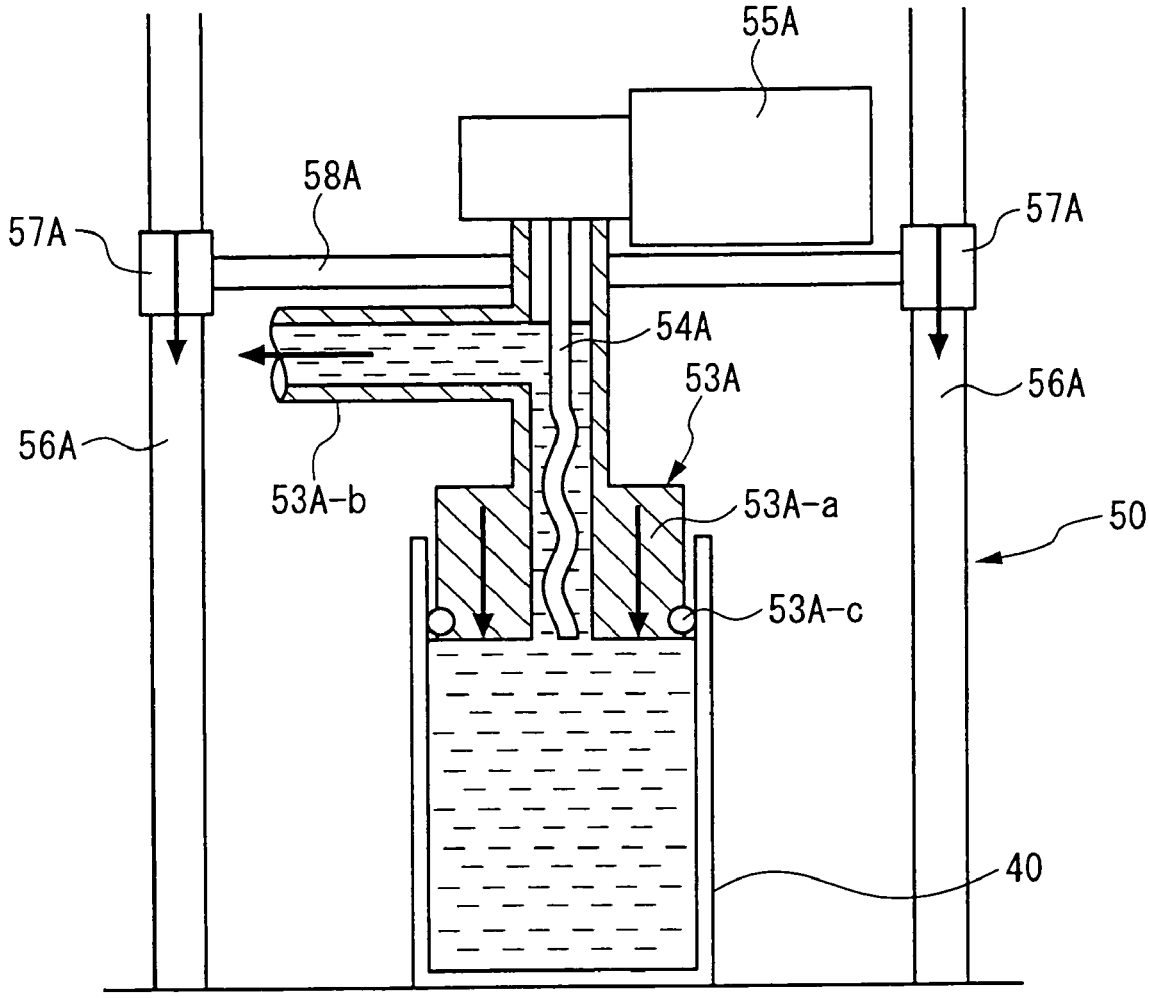
FIG. 4 is an enlarged view of essential parts of the ink returning device portion.
Figure 5:
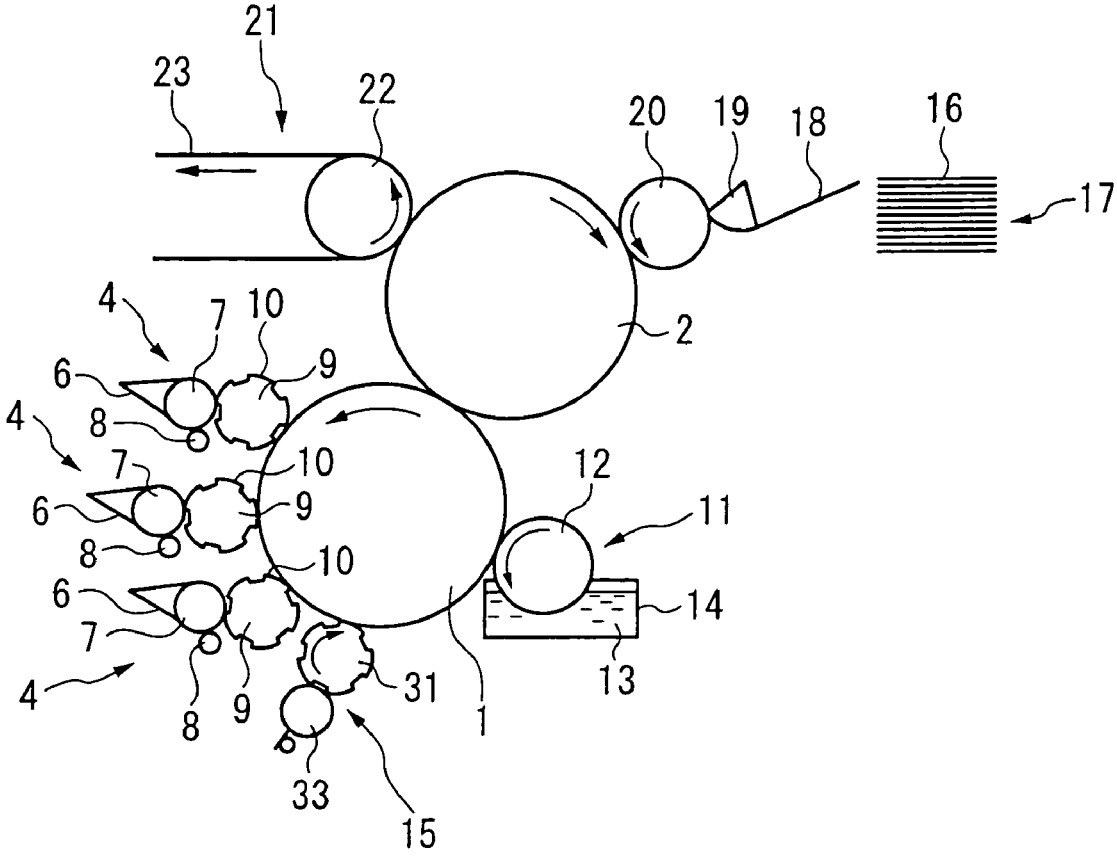
FIG. 5 is a schematic side view of the intaglio printing press.
Figure 6:
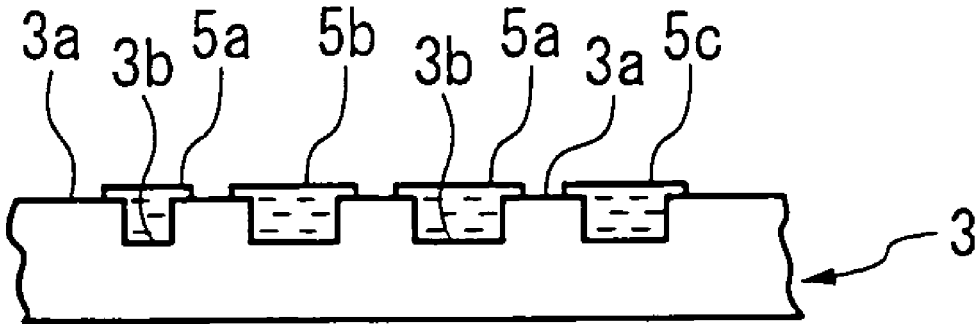
FIG. 6 is an explanation drawing of an intaglio plate.

FIG. 1 is a schematic side view of an ink removing device portion and an ink returning device portion of an intaglio printing press showing Embodiment 1 of the present invention. FIG. 2 is a schematic perspective view of the ink removing device portion. FIG. 3 is an enlarged view of essential parts of the ink removing device portion. FIG. 4 is an enlarged view of essential parts of the ink returning device portion. FIG. 5 is a schematic side view of the intaglio printing press. FIG. 6 is an explanation drawing of an intaglio plate. Arrows in the drawings represent the direction of rotation of a cylinder or a roller.

In FIG. 5, reference numeral 1 denotes an intaglio cylinder in contact with an impression cylinder 2. An intaglio plate 3, which has flat non-image areas 3*a* and image areas (areas forming a pattern) 3*b* concave relative to the non-image areas 3*a* as shown in FIG. 6, is mounted on the circumferential surface of the intaglio cylinder 1. If a printing product having a plurality of colors is to be produced, inks 5*a* to 5*c* of predetermined colors have to be supplied to the image areas 3*b* of the intaglio plate 3. For this purpose, inking devices 4 (to be described later) for supplying the inks 5*a* to 5*c* to the intaglio plate 3 can be adapted to supply the inks 5*a* to 5*c* of predetermined colors to predetermined image areas 3*b* (strictly, also to non-image areas 3*a* surrounding them)

In the present embodiment, inks of three colors are used for producing a printing product. Three inking devices 4 are provided on one side of the intaglio cylinder 1 (where necessary, these inking devices 4 are called a first inking device, a second inking device, and a third inking device in this order along the rotating direction of the intaglio cylinder 1). Each inking device 4 is composed of an ink fountain 6 storing ink of a predetermined color, an ink fountain roller 7 partly contacting ink within the ink fountain 6, an oscillating roller 8 in contact with the ink fountain roller 7 and oscillated in the direction of the roller axis for conditioning ink on the ink fountain roller 7, and an ink supply pattern roller (ink form roller) 9 in contact with the ink fountain roller 7 and also in contact with the intaglio cylinder 1.

Each ink supply pattern roller 9 is configured to have a convex supply pattern portion (pattern region) 10 on the surface so as to be able to supply ink, which the pattern roller 9 is to supply, to a location of the intaglio cylinder 1 to be supplied with ink of the relevant color (i.e., the image areas 3*b* of the intaglio plate 3), namely, so as to contact only this location. Thus, the ink in the ink fountain 6 is discharged by the ink fountain roller 7, conditioned and distributed by the oscillating roller 8, then transferred to the supply pattern portion 10 of the pattern roller 9, and supplied from the supply pattern portion 10 to the predetermined location of the intaglio cylinder 1.

A wiping device 11, as an ink removing device, is provided at a position upstream, with respect to the rotating direction, of the position of contact between the intaglio cylinder 1 and the impression cylinder 2. The wiping device 11 is composed of a wiping roller 12 in contact with the intaglio cylinder 1, and a cleaning tank 14 storing a cleaning solution 13 in which a lower half portion of the wiping roller 12 is soaked. The wiping roller 12 rotates in an opposite direction relative to the intaglio cylinder 1, namely, rotates so as to rub against the intaglio cylinder 1, thereby acting to wipe off surplus ink on the non-image areas 3*a* of the intaglio plate 3 of the intaglio cylinder 1.

A prewiping device 15, as an ink removing device, is provided upstream of the wiping device 11 with respect to the rotating direction of the intaglio cylinder 1 and downstream of the pattern roller 9 of the third inking device 4 with respect to the rotating direction of the intaglio cylinder 1. The prewiping device 15 removes surplus ink on the intaglio plate 3 before it is wiped off by the wiping device 11. Details of the removing mechanism will be described later.

Sheets 16 to be subjected to printing are piled on a feeding device 17, and sent out, one by one, onto a feedboard 18. A swing arm shaft pregripper 19 is disposed on the feedboard 18, and a transfer cylinder 20 is provided in succession to the swing arm shaft pregripper 19. The transfer cylinder 20 has a gripper device (not shown) for gripping the sheet 16. The transfer cylinder 20 is in contact with the impression cylinder 2. The impression cylinder 2 is also equipped with a gripper device (not shown) for gripping the sheet 16.

A delivery device 21 is provided downstream, with respect to the rotating direction, of the site of contact between the impression cylinder 2 and the intaglio cylinder 1, and sideward of the impression cylinder 2. The delivery device 21 has a delivery cylinder 22 in contact with the impression cylinder 2, and a pair of delivery chains 23 looped between a sprocket coaxial with the delivery cylinder 22 and a sprocket (not shown). The delivery chain 23 is provided with a plurality of delivery gripper devices (not shown), which are spaced apart by a predetermined distance in the running direction of the delivery chain 23, for receiving the sheet 16 from the gripper device of the impression cylinder 2 and gripping it.

The printing action of the intaglio printing press described above will be outlined. The sheets 16 are fed, one by one, from the feeding device 17 onto the feedboard 18. The sheet 16 is then transferred to the transfer cylinder 20 by the swing arm shaft pregripper 19, and gripped by the gripper device of the transfer cylinder 20. The sheet 16 gripped by the transfer cylinder 20 is passed on to the impression cylinder 2 by gripping change. The sheet 16 being wound round the circumferential surface of the impression cylinder 2 enters the site of contact between the impression cylinder 2 and the intaglio cylinder 1.

Ink in the ink fountain 6 of each inking device 4 is supplied to the intaglio cylinder 1 via the ink fountain roller 7 and the pattern roller 9. Desired ink on the intaglio cylinder 1 is first removed by the prewiping device 15. Then, all of the surplus ink on the intaglio cylinder 1 is wiped off by the wiping roller 12 of the wiping device 11. By this wiping-off action, inks 5*a* to 5*c* on the non-image areas 3*a* of the intaglio plate 3 are completely removed, and the inks 5*a* to 5*c* remain only in the image areas 3*b*.

The sheet 16 is supplied to the site of contact between the intaglio cylinder 1 in such a state and the impression cylinder 2. The sheet 16 is pressed against the intaglio plate 3 on the intaglio cylinder 1 under a strong pressure by the impression cylinder 2. As a result, the inks 5*a* to 5*c* in the image areas 3*b* of the intaglio plate 3 are transferred to the sheet 16 to perform printing. During this process, inks from the three pattern rollers 9 are directly transferred to the intaglio cylinder 1, so that a so-called three-color intaglio direct printing is carried out, whereby a print (three-color) with a thick ink film can be made. The printed sheet 16 is passed onto and gripped by the delivery cylinder 22 of the delivery device 21, and further gripped by the delivery gripper devices of the delivery chains 23 until it is discharged.

Next, details of the aforementioned prewiping device 15 as an ink removing device will be described with reference to FIGS. 1 to 4.

The prewiping device 15 has a prewiping roller 31 in contact with the intaglio cylinder 1. The prewiping roller 31 has a convex recovery pattern portion (pattern region) 32 formed in correspondence with the locations of the intaglio plate 3, where desired ink is carried, in order to recover the desired ink. In detail, there are three of the inking devices 4, and three inks are supplied to the intaglio plate 3. If one of the three inks is to be mainly recovered, the recovery pattern portion 32 is formed in correspondence with the locations where the ink is placed. This prewiping roller 31 is intended not to wipe off ink, like the succeeding wiping device 11, but to have the ink on the intaglio plate 3 transferred to the prewiping roller 31. Thus, the direction of rotation of the prewiping roller 31 at the site of its contact with the intaglio cylinder 1 is the same as the rotating direction of the intaglio cylinder 1.

An ink scraping roller 33, as an ink transfer roller, is in contact with the prewiping roller 31. The ink transferred to the recovery patter portion 32 of the prewiping roller 31 is transferred to the ink scraping roller 33.

The front end of a blade (doctor blade) 34 for scraping off ink on the ink scraping roller 33 makes contact with the ink scraping roller 33. A support member 36 is provided on a shaft 35 parallel to the ink scraping roller 33, and the blade 34 is mounted on the support member 36. The shaft 35 is supported by frames 38 of an inking unit 37 to which the inking devices 4 are assembled. A hot plate may be annexed to the blade 34 and the support member 36 to prevent a decrease in the viscosity of the removed ink.

The ink scraped off by the blade 34 is passed over the support member 36, dropped onto a belt 39*c* of a belt conveyor device 39 under its own weight, and discharged to the outside of the printing press by the belt 39*c* through a notch opening 38*a* of the frame 38. The belt conveyor device 39 comprises the aforementioned belt 39*c* looped between at least two rollers 39*b* which are journaled between a pair of (i.e., right and left) support frames 39*a* and disposed in a longitudinal direction (belt running direction). The belt conveyor device 39 is operated intermittently by a timer. Outside the printing press, ink on the belt 39*c* is scraped off by a blade (belt conveyor blade) 41, and accommodated in a drum (container) 40. Thus, the prewiping device 15 includes the prewiping roller 31, the ink scraping roller 33, the blade 34, the belt conveyor device 39, and the blade 41.

In the present embodiment, an ink returning device 50 is further provided for returning the ink recovered into the drum 40 to the aforementioned inking devices 4 for the purpose of recycling.

The ink returning device 50 has ink supply pipings 51A, 51B and 51C for bringing three of the drums 40 and three of the inking devices 4 into communication. Valves 52A, 52B and 52C, which are opened and closed in interlocked relationship with a pumping motor and a rodless cylinder to be described later, are interposed in the ink supply pipings 51A, 51B and 51C, respectively. The inks within the drums 40 are supplied as supplements by these valves 52A, 52B and 52C in accordance with decreases in the amounts of inks within the ink fountains 6. In FIG. 1, reference numerals 54A, 54B and 54C denote pumps for forcing the inks within the ink supply pipings 51A, 51B and 51C into the inking devices 4 when the valves 52A, 52B and 52C are opened.

The interiors of the drums 40 are pressurized by pressing bodies as pressure imparting means. For example, a pressing body 53A for the ink supply piping 51A comprises a piston portion 53A-a movable up and down within the drum 40 while being rendered liquid-tight by a sealing member 53A-c, and a pipe portion 53A-b constituting a part of the ink supply piping 51A, being connected to the ink supply piping 51A via a flexible tube or the like (not shown), and communicating with the interior of the drum 40. The pressing body 53A is secured to an elevating base 58A which can be moved up and down on a pair of support pillars 56A by a pair of rodless cylinders 57A. The aforementioned pump 54A consisting of a spiral shaft is inserted vertically into the pipe portion 53A-b. The aforementioned motor 55A for rotating the pump 54A is placed on the elevating base 58A. Pressing bodies for the ink supply pipings 51B and 51C are also similarly constructed, and thus duplicate explanations will be omitted. In this manner, the ink returning device 50 is constructed by the pressing bodies 53A, etc., ink supply pipings 51A, etc., pumps 54A, etc. and so on.

Because of the above features, desired ink in the inking device 4 (in the illustrated embodiment, ink in the first inking device 4) is transferred to the intaglio cylinder 1, and then surplus ink is wiped off by the prewiping roller 31 of the prewiping device 15. This wiped-off ink is transferred to the ink scraping roller 33, then scraped off by the blade 34, and carried on the belt 39*c* of the belt conveyor device 39.

By the intermittent operation of the belt conveyor device 39, ink on the belt 39*c* is transported to the outside of the printing press, scraped off from above the belt 39*c* by the blade 41 disposed at an end portion of the belt conveyor device 39 protruding to the outside of the printing press, and stored into the drum 40 for recovery.

The ink removed from the intaglio cylinder 1 can be transported to the outside of the printing press by the belt conveyor device 39. Thus, the ink can be automatically recovered, the burden on the operator can be decreased markedly, and productivity can be increased remarkably. Moreover, ink with high viscosity can be easily discharged to the outside of the printing press by the belt conveyor device 39. Furthermore, the ink can be reliably scraped off the ink scraping roller 33 by the blade 34. In addition, the ink can be reliably scraped off the belt 39*c* by the blade 41.

When a predetermined amount of ink is recovered into the drum 40, the ink is moved to the ink returning device 50 by the operator, and set in place of the drum 40 full of fresh ink to be supplied to the inking device 4 for the same color as the color of the ink, namely, the first inking device 4. That is, the drum 40 is connected to the pressing body 53A for the ink supply piping 51A.

Then, the rodless cylinders 57A are actuated responsive to the valve 52A, whereby the elevating base 58A is lowered to move the pressing body 53A downward. As a result, the interior of the drum 40 is pressurized, whereupon the ink is pushed out into the pipe portion 53A-b and brought to the pump 54A. This ink is passed through the ink supply piping 51A by the rotation of the pump 54A, and supplied into the ink fountain 6 of the first inking device 4. This ink supply is continued during a period during which the valve 52A is opened. That is, the ink returning device 50 is controlled in the following manner: When an ink level sensor (not shown) provided in each inking device 4 detects that the amount of ink within the ink fountain 6 has become a certain value or less, ink is supplied into the ink fountain 6. When the ink level sensor detects that the ink within the ink fountain 6 has reached a predetermined amount, supply of ink into the ink fountain 6 is stopped.

In this manner, the recovered ink in the drum 40 is returned to the inking device 4 by the ink returning device 50 for the purpose of recycling. During this process, the ink is pushed out to the pipe portion 53A-b by the pressing body 53A, and the pushed-out ink is pumped out toward the inking device 4 by the pump 54A. Thus, ink with high viscosity can be reliably pushed to the pump 54A, thus making possible the recycling of highly viscous ink. Moreover, a combination of the belt conveyor device 39 of the prewiping device 15 and the ink returning device 50 can construct an ink recycling system, which eliminates a waste of ink recovered from the intaglio cylinder 1. It goes without saying that the drum 40 full of fresh ink is set for the ink supply piping 51A, whereby the fresh ink can be supplied to the first inking device 4 in the same manner as for the ink supply pipings 51B and 51C.

Embodiment 2

Figure 7:
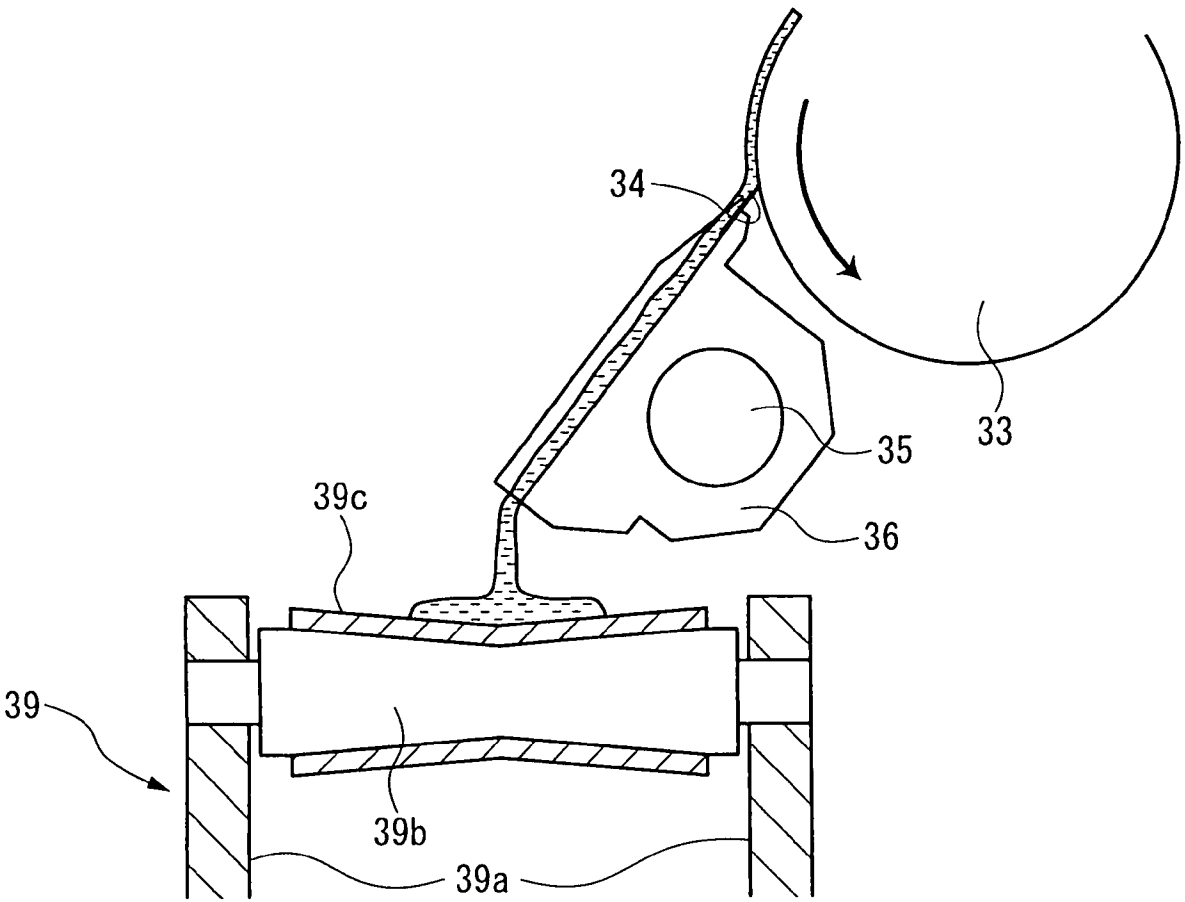
FIG. 7 is an enlarged view of essential parts of an ink removing device portion showing Embodiment 2 of the present invention.

FIG. 7 is an enlarged view of essential parts of an ink removing device portion showing Embodiment 2 of the present invention.

This is an example in which an hourglass-shaped roller having a narrowed middle (reduced diameter) portion is used as the roller 39*b* of the belt conveyor device 39 in Embodiment 1 to render the middle of the belt 39*c* concave. Other features are the same as those in Embodiment 1.

According to this embodiment, the advantage that even ink with a relatively low viscosity can be reliably held on the belt 39*c* and smoothly transported can be obtained in addition to the same actions and effects as those in Embodiment 1.

Embodiment 3

Figure 8:
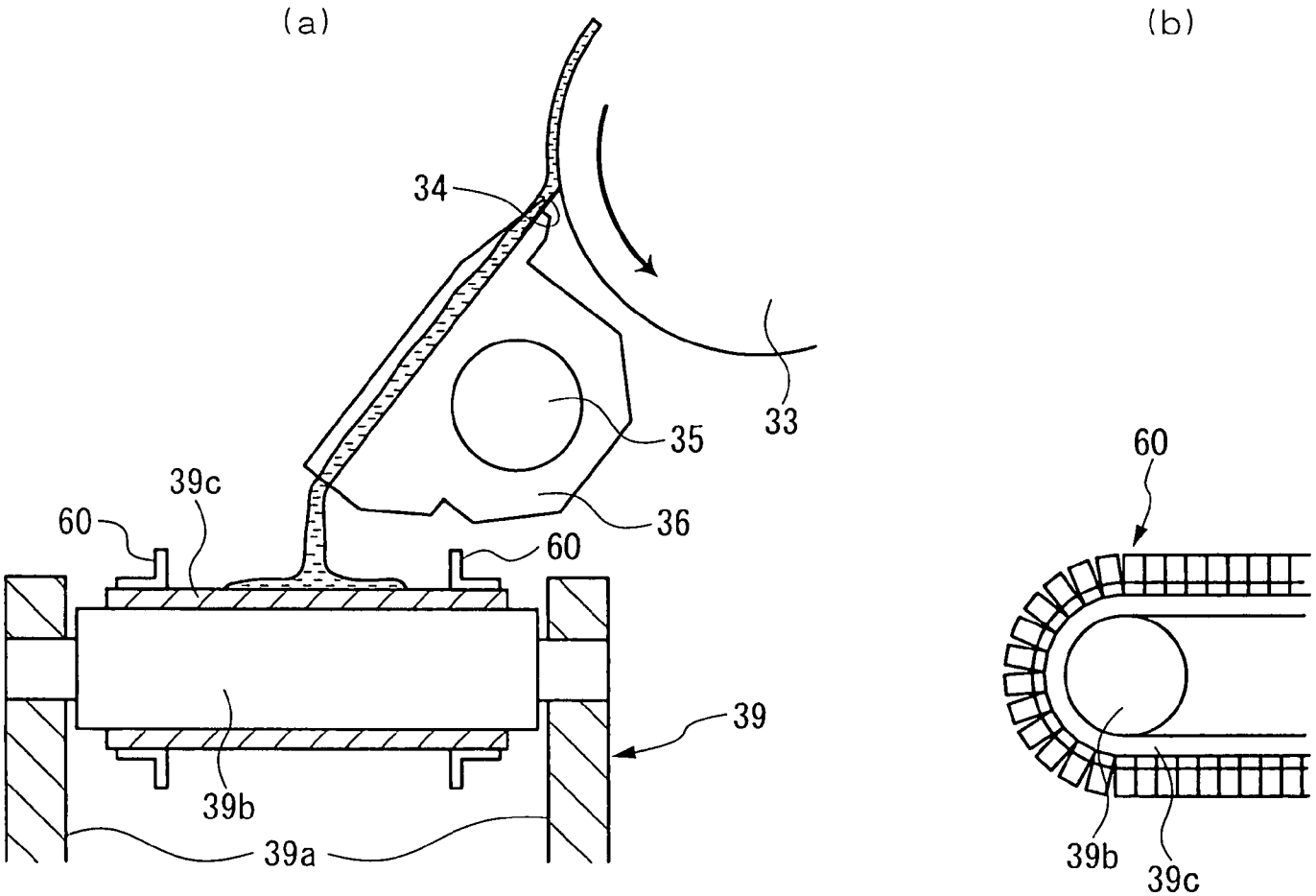
FIG. 8 is an enlarged view of essential parts of an ink removing device portion showing Embodiment 3 of the present invention.

FIG. 8 is an enlarged view of essential parts of an ink removing device portion showing Embodiment 3 of the present invention.

This is an example in which, on the belt 39*c* of the belt conveyor device 39 in Embodiment 1, a wall portion 60, which comprises a plurality of small walls arranged side by side in the longitudinal direction of the belt, is provided along each of side edge portions of the belt 39*c*. Other features are the same as those in Embodiment 1.

According to this embodiment, the advantage that even ink with relatively low viscosity can be reliably held on the belt 39*c* and smoothly transported can be obtained in addition to the same actions and effects as those in Embodiment 1.

Embodiment 4

Figure 9:
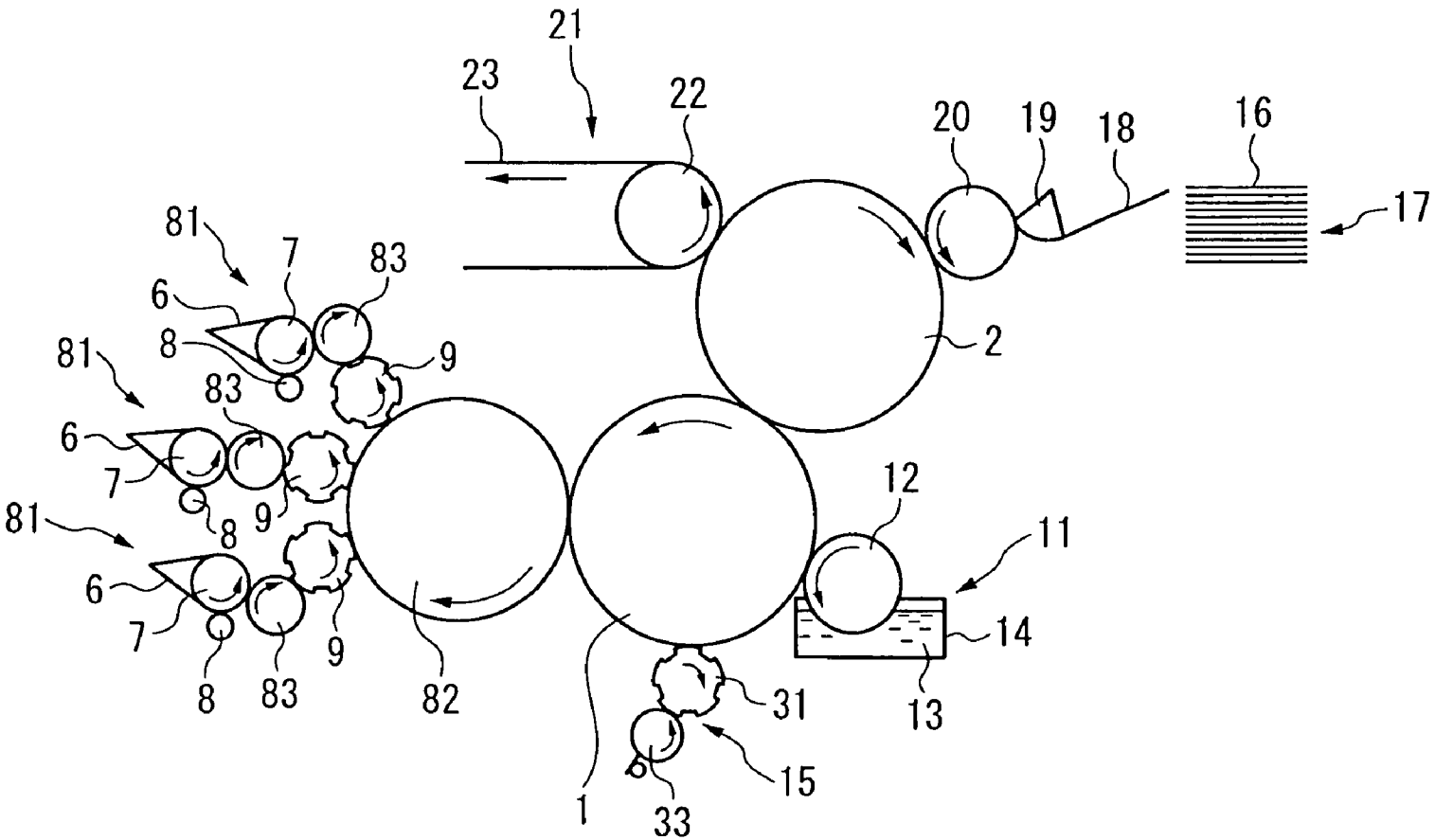
FIG. 9 is a schematic side view of an intaglio printing press showing Embodiment 4 of the present invention.
Figure 10:
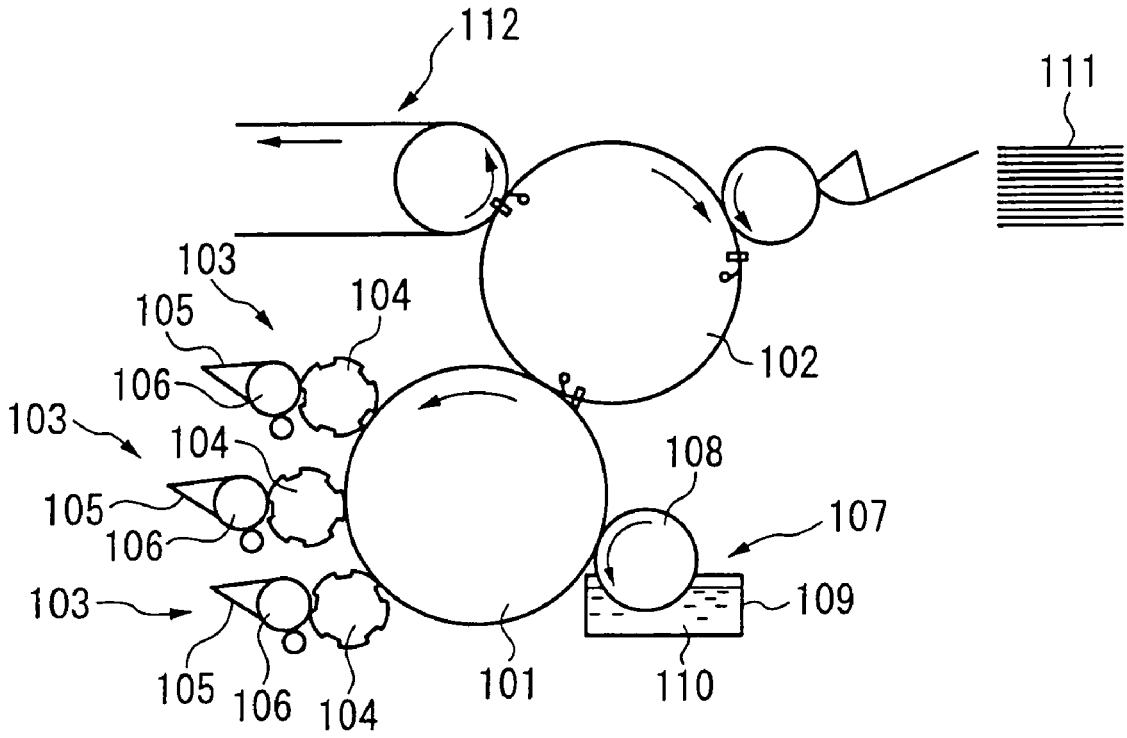
FIG. 10 is a schematic side view of an intaglio printing press as a conventional example.

FIG. 9 is a schematic side view of an intaglio printing press showing Embodiment 4 of the present invention.

In this intaglio printing press, ink is not directly supplied from an inking device 81 to an intaglio cylinder 1. Instead, all inks are gathered on a collecting cylinder 82, which is a blanket cylinder, and the gathered inks are transferred to the intaglio plate of the intaglio cylinder 1. Pattern rollers 9, which are ink form rollers of the inking devices 81, are in contact with the collecting cylinder 82. The inking device 81 is also different from the inking device 4 in that ink is not directly supplied from a fountain roller 7 to the pattern roller 9, but a distribution roller (rubber roller) 83 is provided between the fountain roller 7 and the pattern roller 9. A prewiping device 15 is provided between the site of contact of the collecting cylinder 82 with the intaglio cylinder 1 and a wiping device 11. Other features are the same as those in Embodiment 1. In the "What is claimed is" section, the inking device 81 and the collecting cylinder 82 are collectively expressed as an inking device.

In this intaglio printing press, ink from the inking device 81 is transferred to the collecting cylinder 82 via the pattern roller 9. As an arrangement indicated in the drawing shows, ink is transferred onto the collecting cylinder 82 sequentially, starting with the lowermost inking device 81. Because of contact between the collecting cylinder 82 and the intaglio cylinder 1, ink on the collecting cylinder 82 is transferred onto the intaglio plate of the intaglio cylinder 1. Surplus ink on the intaglio plate is recovered by the prewiping device 15 ahead of the wiping device 11. The action for recovery of ink by the prewiping device 15, and the action for return of ink are the same as those in Embodiment 1.

According to this embodiment, inks from the three pattern rollers 9 are transferred to the intaglio cylinder 1 via the collecting cylinder 82, so that so-called three-color intaglio indirect printing is carried out, whereby the advantage is obtained that a print with a thin ink film can be made. Other effects are the same as those in Embodiment 1.

While the present invention has been described by the above embodiments, it is to be understood that the invention is not limited thereby, but may be varied or modified in many other ways. For example, the belt conveyor device 39 may be operated continuously, or may be operated when the amount of ink accumulated on the belt 39*c* is detected. Alternatively, the amount of ink accumulated on the belt 39*c* may be visually checked, and the operator may manually operate the belt conveyor device 39 by actuating a switch. Assume that ink of only one color is used in intaglio printing, and this ink is recovered for recycling, or that surplus ink on the intaglio cylinder 1 is scraped off, and merely carried out of the printing press. In such a case, the prewiping roller 31 of the prewiping device 15 may have an entirely flat circumferential surface. The ink scraping roller 33 is configured to have ink on the intaglio cylinder 1 transferred thereto via the prewiping roller 31. However, the ink scraping roller 33 may be directly brought into contact with the intaglio cylinder 1 to have surplus ink on the intaglio cylinder 1 directly transferred thereto, and the ink may be scraped off by the blade 34. The embodiments of the present invention described above show that the ink removing device using the belt conveyor device 39 is applied to the prewiping device 15. However, this ink removing device may be applied to the wiping device 11 of the intaglio printing press without the prewiping device 15. Such variations or modifications are not to be regarded as a departure from the spirit and scope of the invention, and all such variations and modifications as would be obvious to one skilled in the art are intended to be included within the scope of the appended claims.

What is claimed is:

1. An intaglio printing press, comprising:

an intaglio cylinder supported rotatably and including locations where a desired ink is applied; and an ink removing device for removing a surplus ink from an ink supplied to said intaglio cylinder, wherein said ink removing device includes a recovery pattern portion, corresponding to the locations on the intaglio cylinder where the desired ink is applied, that removes only the desired ink on said intaglio cylinder as the surplus ink, and a belt conveyor device for discharging said removed surplus ink to an outside of said printing press.

2. The intaglio printing press according to claim 1, wherein said ink removing device has a belt conveyor blade for scraping off said ink on said belt conveyor device.

3. The intaglio printing press according to claim 1, wherein an hourglass-shaped roller having a narrowed middle is used as a roller of said belt conveyor device to render a middle of a belt of said belt conveyor device concave along said narrowed middle of said roller.

4. The intaglio printing press according to claim 1, wherein on a belt of said belt conveyor device, a wall portion, which includes a plurality of small walls arranged side by side in a longitudinal direction of said belt, is provided along each of side edge portions of said belt.

5. The intaglio printing press according to claim 1, wherein the recovery pattern portion make contact with the intaglio cylinder.

6. The intaglio printing press according to claim 1, wherein the recovery pattern portion is formed on a roller.

7. The intaglio printing press according to claim 1, wherein the recovery pattern portion is convex.

* * * * *